US012460360B2

(12) United States Patent
Liu et al.

(10) Patent No.: US 12,460,360 B2
(45) Date of Patent: Nov. 4, 2025

(54) BRIDGE EXPANSION JOINT STRUCTURE AND CONSTRUCTION METHOD THEREOF

(71) Applicants: JSTI GROUP, Jiangsu (CN); NANJING TECH UNIVERSITY, Jiangsu (CN)

(72) Inventors: Duo Liu, Jiangsu (CN); Jiandong Zhang, Jiangsu (CN); Xiaonan Feng, Jiangsu (CN); Runbo Liu, Jiangsu (CN); Chang Yan, Jiangsu (CN); Ming Li, Jiangsu (CN)

(73) Assignees: JSTI GROUP, Jiangsu (CN); NANJING TECH UNIVERSITY, Jiangsu (CN)

( * ) Notice: Subject to any disclaimer, the term of this patent is extended or adjusted under 35 U.S.C. 154(b) by 0 days.

(21) Appl. No.: 18/951,588

(22) Filed: Nov. 18, 2024

(65) Prior Publication Data

US 2025/0092621 A1 Mar. 20, 2025

Related U.S. Application Data

(63) Continuation of application No. PCT/CN2022/133146, filed on Nov. 21, 2022.

(30) Foreign Application Priority Data

May 20, 2022 (CN) ..... 202210554306.6

(51) Int. Cl.
*E01D 19/06* (2006.01)

(52) U.S. Cl.
CPC ..... *E01D 19/062* (2013.01)

(58) Field of Classification Search
CPC ..... E01D 19/06; E01D 19/062
USPC ..... 14/73.1, 73.5
See application file for complete search history.

(56) References Cited

U.S. PATENT DOCUMENTS 3,604,322 A * 9/1971 Koster ..... E01D 19/062 14/73.1
4,058,867 A * 11/1977 Puccio ..... E01D 19/062 404/69
5,887,308 A * 3/1999 Walter ..... E01D 19/062 404/69

(Continued)

FOREIGN PATENT DOCUMENTS

CN 101063298 A 10/2007
CN 104153289 A 11/2014

(Continued)

*Primary Examiner* — Gary S Hartmann
(74) *Attorney, Agent, or Firm* — Rondaus PLLC; George Liu

(57) ABSTRACT

The assembly-type bridge expansion joint structure comprises a to-be-connected bridge beam end, wherein a number of the to-be-connected bridge beam end is two, and a groove platform is provided on each of the two beam ends in an extending direction of a gap; a connecting box body, wherein a number of the connecting box body is two, each of the two connecting box bodies is fixedly arranged on the groove platform of the beam end, and a box chamber is provided on opposite side surfaces of the two connecting box bodies respectively, a plurality of box chambers are provided, which are open opposite each other, and the box chamber is provided in the extending direction of the gap; a number of the side beam is two.

8 Claims, 6 Drawing Sheets

(56) References Cited

U.S. PATENT DOCUMENTS

| | | | | |
|---|---|---|---|---|
| 7,252,454 | B2 * | 8/2007 | Bradford | E01D 19/062 14/73.1 |
| 7,489,045 | B1 * | 2/2009 | Bradford | H02K 7/1876 290/1 R |
| 8,919,065 | B2 * | 12/2014 | Bradford | E01D 19/062 52/396.04 |
| 2022/0282434 | A1 * | 9/2022 | Hoffmann | E01D 19/062 |

FOREIGN PATENT DOCUMENTS

| | | | | | |
|---|---|---|---|---|---|
| CN | 204803754 | U | | 11/2015 | |
| CN | 106320169 | A | | 1/2017 | |
| CN | 107299590 | A | | 10/2017 | |
| CN | 207727423 | U | | 8/2018 | |
| CN | 110331660 | A | * | 10/2019 | E01D 19/06 |
| CN | 209836788 | U | | 12/2019 | |
| CN | 210712537 | U | | 6/2020 | |
| CN | 112649811 | A | | 4/2021 | |
| CN | 113957786 | A | | 1/2022 | |
| CN | 215518337 | U | | 1/2022 | |
| CN | 114991001 | A | | 9/2022 | |
| DE | 19705531 | A1 | * | 8/1998 | E01D 19/062 |
| KR | 20020033992 | A | | 5/2002 | |
| KR | 2015145484 | A | * | 12/2015 | E01C 11/02 |
| WO | 2016041248 | A1 | | 3/2016 | |

* cited by examiner

BRIDGE EXPANSION JOINT STRUCTURE AND CONSTRUCTION METHOD THEREOF

TECHNICAL FIELD

The present disclosure belongs to the technical field of bridge expansion joint construction, and particularly relates to an easily maintainable assembly-type bridge expansion joint structure and a construction method thereof.

BACKGROUND

When the expansion device of a bridge expansion joint fails to function properly, traditional expansion devices require traffic closure for either repairing the concrete area or replacing the expansion device, causing significant disruption to traffic. Furthermore, the complex construction process and long duration required for traditional expansion devices, coupled with the relatively long concrete curing time, extend the period of traffic closure. The frequent maintenance and replacement of bridge expansion devices also impose a heavy burden on the management and maintenance departments of highways and bridges.

SUMMARY

The objective of the present disclosure is to overcome the deficiencies in the prior art by providing an easily maintainable assembly-type bridge expansion joint structure and a construction method thereof, which enhance the assembly efficiency of expansion joint assembly structure, improve structural stability, and offer greater flexibility in assembly and maintenance, making them suitable for practical applications.

To achieve the above objective, the present disclosure adopts the following technical solutions:

In the first aspect, the present disclosure provides an easily maintainable assembly-type bridge expansion joint structure, comprising:

a to-be-connected bridge beam end, wherein a number of the to-be-connected bridge beam end is two, and a groove platform is provided on each of the two beam ends in an extending direction of a gap;

a connecting box body, wherein a number of the connecting box body is two, each of the two connecting box bodies is fixedly arranged on the groove platform of the beam end, and a box chamber is provided on opposite side surfaces of the two connecting box bodies respectively, a plurality of box chambers are provided, which are open opposite each other, and the box chamber is provided in the extending direction of the gap;

a cross beam, wherein a plurality of cross beams are provided, bottoms of the two ends of the cross beam are connected to an inner bottom plate of the box chamber that is open opposite each other in the two connecting box bodies via a first elastic supporting seat respectively;

a side beam, wherein a number of the side beam is two, the side beam spans the plurality of cross beams in the extending direction of the gap, a bottom of the side beam is connected to a top of the cross beam via a second elastic supporting seat, and a top of the side beam is fixedly connected to a top of the box chamber; and at least one middle beam, a bottom of the middle beam is fixedly arranged on the cross beam and located between the two side beams, and two sides of a top of the middle beam are elastically connected to the tops of the two side beams via an elastic telescopic piece respectively, and a groove filled with silicone gel is formed between the side beam, the elastic telescopic piece and the middle beam in the extending direction of the gap.

Further, the connecting box body comprises an L-shaped full-length steel plate matched with the groove platform in appearance, a displacement box and a concrete platform, a plurality of displacement boxes are provided and a plurality of concrete platforms are provided, the displacement box is arranged on a steel plate at intervals in the extending direction of the gap and is provided with the box chamber with an opening, and the concrete platform is fixedly installed or poured between adjacent displacement boxes.

Further, a rubber gasket is arranged between the displacement box and the steel plate, the displacement box is fixedly connected the bolts that sequentially penetrate through bolt holes on vertical side surfaces of the displacement box, the rubber gasket and the steel plate into the pre-embedded connector on the groove platform, and the pre-embedded connector comprises a connecting steel bar and an internal threaded sleeve fixedly connected with the connecting steel bar.

Further, both the steel plate and the groove platform are provided with a space filled with concrete mortar between a vertical direction and a horizontal direction, a rubber baffle for sealing the space is arranged at a port of the space in the horizontal direction, and a grouting hole communicated with the space is formed on horizontal bottom side surfaces of the displacement box, the rubber gasket and the steel plate in a penetrating mode and is used for pouring concrete mortar into the space.

Further, the groove platform is fixedly provided with at least one bolt base plate in the space in the horizontal direction, bolts moving up and down are arranged on the displacement box, the rubber gasket and the steel plate corresponding to the bolt base plate in a penetrating mode, the bolt abuts against the bolt base plate at a bottom end, and a vertical position height of the displacement box is adjusted by continuing to tighten the bolt upwards or downwards.

Further, an end of the inner threaded sleeve is provided with a circular rubber pad exposed out of the space in the vertical direction, and an outer end of the circular rubber pad abuts against the vertical side surface of the steel plate; and a chamfer is arranged at L-shaped corners of the displacement box, the rubber gasket and the steel plate.

Further, the top of the box chamber of the displacement box is provided with a detachable box cover, the box cover is connected to a top surface of the box chamber of the displacement box via the bolt, and the box cover is covered with a prefabricated concrete plate or a concrete layer poured to cover the box cover.

Further, a bar-shaped pin is fixedly connected to a bottom of the bolt arranged on the box cover in a penetrating mode, a top end of the box chamber of the displacement box is provided with a fixing plate with a bar-shaped pin hole, and the bar-shaped pin penetrates through the bar-shaped pin hole and is screwed to be in vertical cross buckle connection with the bar-shaped pin hole.

In the second aspect, the present disclosure further provides a construction method for the easily maintainable assembly-type bridge expansion joint structure according to any one of the first aspects, comprising the following steps:

constructing an L-shaped stepped groove platform at each of two to-be-connected bridge beam ends, pre-embedding a pre-embedded connector formed by fixedly connecting a connecting steel bar and an inner threaded sleeve on a vertical side surface of a groove platform, pre-embedding or pasting a circular rubber pad at a port of the pre-embedded connector, and fixedly arranging at least one bolt base plate on a horizontal bottom surface of the groove platform;

assembling a displacement box, a rubber gasket and a L-shaped full-length steel plate together with bolts on their respective transverse bottom surfaces to form a connecting box body, using a hoisting machinery to hoist the assembled connecting box body onto the corresponding groove platform at the bridge beam end, so that the connecting box body is placed on the groove platform in the extending direction of a gap and horizontally positioned in the front, back, left and right directions;

adjusting the bolts at the horizontal bottom surface to abut against the corresponding bolt base plate, and continuing to tighten the bolts to adjust the vertical height position of the displacement box, after reaching the design elevation, fixedly connecting the bolts that sequentially penetrate through bolt holes on vertical side surfaces of the displacement box, the rubber gasket and the steel plate into the internal threaded sleeve of the pre-embedded connector on the groove platform, and abutting the circular rubber pad against an outer side surface of the L-shaped steel plate, so that a space with a certain distance is reserved between the L-shaped steel plate and the groove platform in the horizontal direction and the vertical direction, and arranging a sealing rubber baffle at a port of the space in the horizontal direction;

sealing two sides of the space between the steel plate of the connecting box body and the groove platform, and injecting concrete mortar through grouting holes penetrating the horizontal bottom surfaces of the displacement box, the rubber gasket and the steel plate until the mortar fills the space and overflows from a top of the space in the vertical direction;

arranging the cross beams on inner bottom plates of the box chambers of the opposite displacement boxes of the two bridge beam ends via the first elastic supporting seat, stretching the two side beams across a plurality of cross beams in the extending direction of the gap and fixedly connecting the two side beams to top surfaces of the cross beams via a second elastic supporting seat, fixing a bottom of a middle beam onto the cross beams and positioning the bottom of the middle beam between the two side beams, and fixedly connecting one end of the top of each side beam to the top of the box chamber of the displacement box while elastically connecting another end to the top of the middle beam via an elastic telescopic piece;

fixedly connecting a bolt with a bar-shaped pin to a box cover in a penetrating mode, penetrating the bar-shaped pin through a fixing plate with a bar-shaped pin hole in a top end of the box chamber, and screwing the bolt until the bolt is buckled at a point where the bar-shaped pin and the bar-shaped pin hole intersect perpendicularly, so that the box cover is connected to the top of the box chamber of the displacement box; and hoisting and fixing a prefabricated concrete platform, matched with the space enclosed by an adjacent displacement box and a steel plate between the two adjacent displacement boxes, hoisting a concrete plate to cover a top surface of the box cover or pouring a concrete layer to cover the top surface of the box cover, and pouring silicone gel in a groove formed in the extending direction of the gap between the side beam, the elastic telescopic piece and the middle beam;

Further, when the expansion joint structure needs to be maintained or replaced, the bolt with the bar-shaped pin on the box cover is loosened, the bar-shaped pin and the bar-shaped pin hole are aligned in the same direction to remove the box cover, and the bolt on the vertical side of the connecting box body is loosened to remove the entire connecting box body;

or the elastic telescopic piece is loosened and removed to separate the side beam from the displacement box, so that a space is arranged between the opposite displacement boxes at the bridge beam end, and maintenance or replacement of the cross beam, the first elastic supporting seat, the second elastic supporting seat and the middle beam is facilitated.

Compared with the prior art, the beneficial effects of the present disclosure are as follows:

The present disclosure employs the easily maintainable assembly-type bridge expansion joint structure and construction method thereof, utilizing paired connecting box bodies with a plurality of displacement boxes containing the box chambers spaced within. The first elastic supporting seat, the cross beam, the second elastic supporting seat, the side beam, the middle beam and the elastic telescopic piece are arranged in the box chamber, which not only collectively form an expansion joint structure between the ends of assembled bridges but also provide more stable, reliable, and adaptable expansion joint performance through the elastic deformation of the first elastic supporting seat, the second elastic supporting seat and the telescopic piece.

The displacement box, the steel plate and the rubber gasket are assembled together and adjusted in height using horizontal bottom bolts, while vertical side bolts are used for fixed connections. By injecting mortar into the space through the grouting holes until it overflows from the top surface of the space, the overall stability of the connecting box bodies, as well as the sealing and stability of the connections with the beam ends, are enhanced.

From the perspective of the assembly construction process, the need for traditional concrete pouring in the expansion joint area is eliminated. The structure can be put into use immediately after being anchored and assembled with bolts, without waiting for concrete setting time. This minimizes the impact on subsequent bridge traffic, improves the overall efficiency of bridge expansion joint construction, making it more practical and valuable for industrial application.

Figure 1:
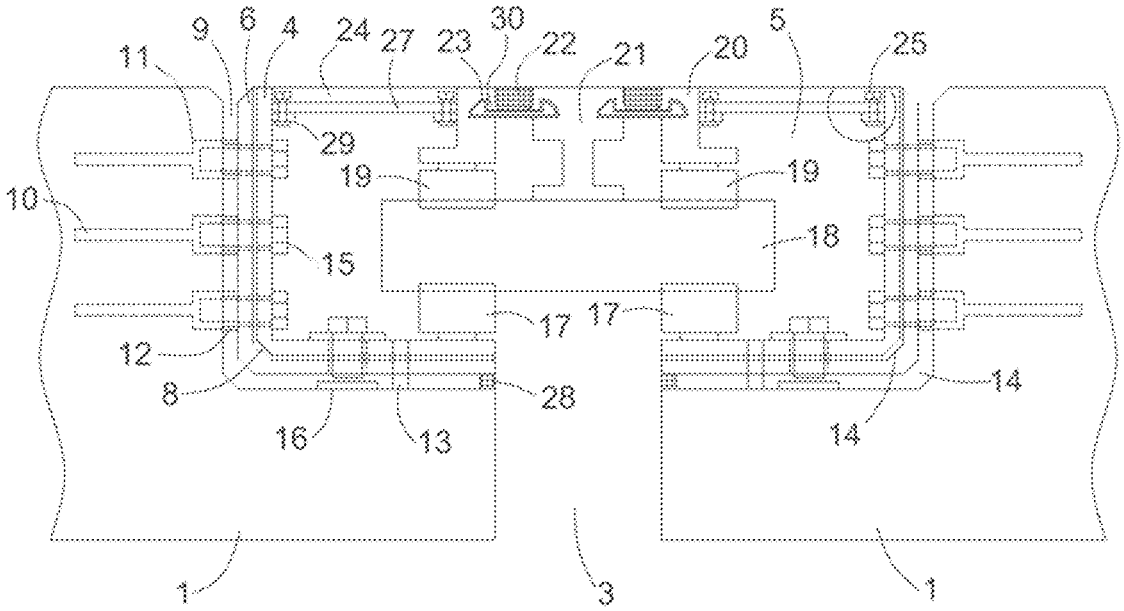
FIG. 1 is a sectional view of an easily maintainable assembly-type bridge expansion joint structure according to an embodiment of the present disclosure.

1, beam end; 2, groove platform; 3, gap; 4, displacement box; 5, box chamber; 6, steel plate; 7, concrete platform; 8, rubber gasket; 9, space; 10, connecting steel bar; 11, internal threaded sleeve; 12, circular rubber pad; 13, grouting hole; 14, chamfer; 15, bolt; 16, bolt base plate; 17, first elastic supporting seat; 18, cross beam; 19, second elastic supporting seat; 20, side beam; 21, middle beam; 22, silicone gel; 23, elastic telescopic piece; 24, concrete plate/concrete layer; 25, bar-shaped pin; 26, bar-shaped pin hole; 27, box cover; 28, rubber baffle; 29, fixing plate; and 30, groove.

DETAILED DESCRIPTION OF THE EMBODIMENTS

The present disclosure is further described below with reference to the accompanying drawings. The following embodiments are only used for more clearly illustrating the technical solution of the present disclosure, and cannot be used to limit the protection scope of the present disclosure.

In the description of the present disclosure, it should be understood that the orientations or positional relationships indicated by the terms "center", "longitudinal", "transverse", "upper", "lower", "front", "rear", "left", "right", "vertical", "horizontal", "top", "bottom", "inner", "outer", etc. are based on the orientations or positional relationships shown in the drawings. They are merely intended to facilitate describing the present disclosure and simplify the description, rather than indicating or implying that the device or element referred to must have a specific orientation, and is constructed and operated in a specific orientation, and therefore cannot be understood as a limitation to the present disclosure. In addition, the terms "first" and "second" are used for descriptive purposes only and cannot be understood as indicating or implying relative importance or implicitly indicating the quantity of indicated technical features. Therefore, features defined as "first", "second", etc. may explicitly or implicitly include one or more of these features. In the description of the present disclosure, unless otherwise specified, "a plurality of" means two or more.

In the description of the present disclosure, it should be noted that, unless otherwise explicitly specified or defined, the terms "installed", "connected with", and "connected to" should be understood in a broad sense. For example, they can refer to fixed connections, detachable connections, or integral connections; they can be mechanical connections or electrical connections; they can be direct connections or indirect connections through intermediate media; and they can represent internal connections between two elements. For those of ordinary skill in the art, the specific meanings of the above terms in the present disclosure can be understood on a case-by-case basis.

Figure 2:
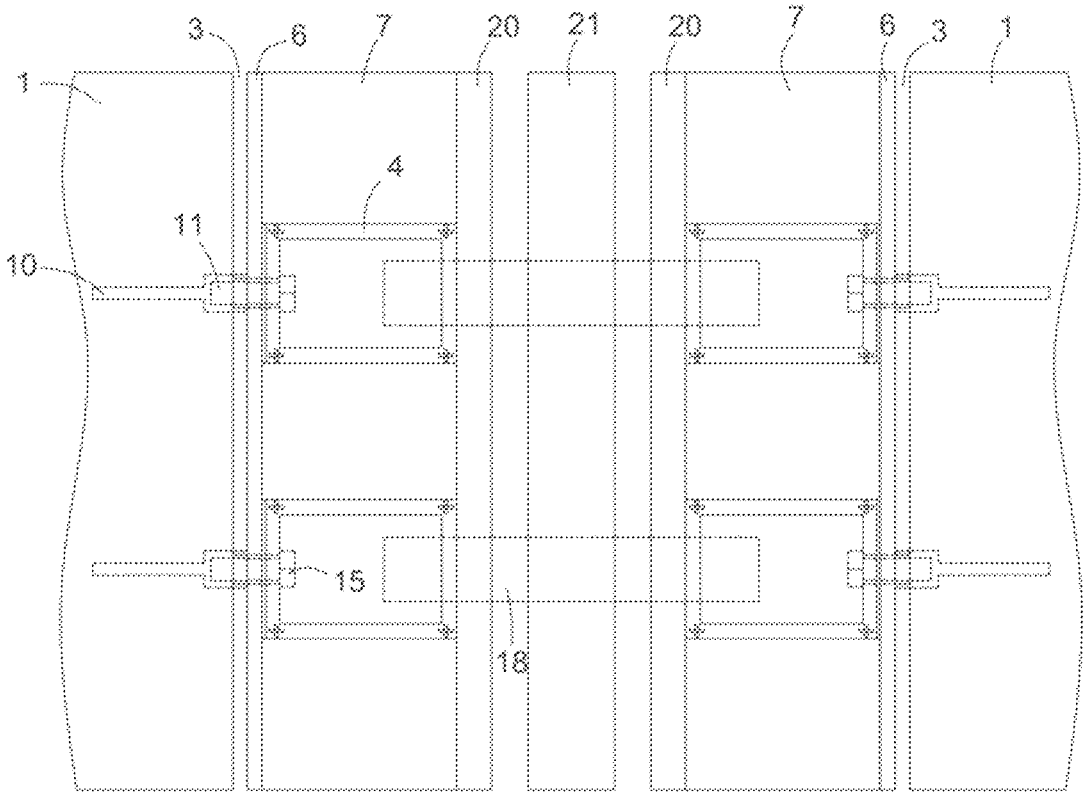
FIG. 2 is a top view of an easily maintainable assembly-type bridge expansion joint structure according to an embodiment of the present disclosure.

As shown in FIG. 1 and FIG. 2, the embodiment of the present disclosure provides an easily maintainable assembly-type bridge expansion joint structure. The structure comprises the following components.

A to-be-connected bridge beam end 1, wherein a number of the to-be-connected bridge beam end 1 is two, and a groove platform 2 is provided on each of the two beam ends 1 in an extending direction of a gap 3;

a connecting box body, wherein a number of the connecting box body is two, each of the two connecting box bodies is fixedly arranged on the groove platform 2 of the beam end 1, and a box chamber 5 is provided on opposite side surfaces of the two connecting box bodies respectively, a plurality of box chambers 5 are provided, which are open opposite each other, and the box chamber 5 is provided in the extending direction of the gap 3;

a cross beam 18, wherein a plurality of cross beams 18 are provided, bottoms of the two ends of the cross beam 18 are connected to an inner bottom plate of the box chamber 5 that is open opposite each other in the two connecting box bodies via a first elastic supporting seat 17 respectively;

a side beam 20, wherein a number of the side beam 20 is two, the side beam 20 spans the plurality of cross beams 18 in the extending direction of the gap 3, a bottom of the side beam 20 is connected to a top of the cross beam 18 via a second elastic supporting seat 19, and a top of the side beam 20 is fixedly connected to a top of the box chamber 5; and at least one middle beam 21, a bottom of the middle beam 21 is fixedly arranged on the cross beam 18 and located between the two side beams 20, and two sides of a top of the middle beam 21 are elastically connected to the tops of the two side beams 20 via an elastic telescopic piece respectively, and a groove 30 filled with silicone gel 22 is formed between the side beam 20, the elastic telescopic piece and the middle beam 21 in the extending direction of the gap.

The elastic telescopic piece 23 can be made of rubber strips or similar materials. The opposing sides of the side beam 20 and the middle beam 21 are respectively provided with grooves for clipping the rubber strips, such as C-shaped grooves. The beam end 1 structure of the rubber strip is matched with the C-shaped groove, facilitating a tight clip connection within the groove.

Figure 5:
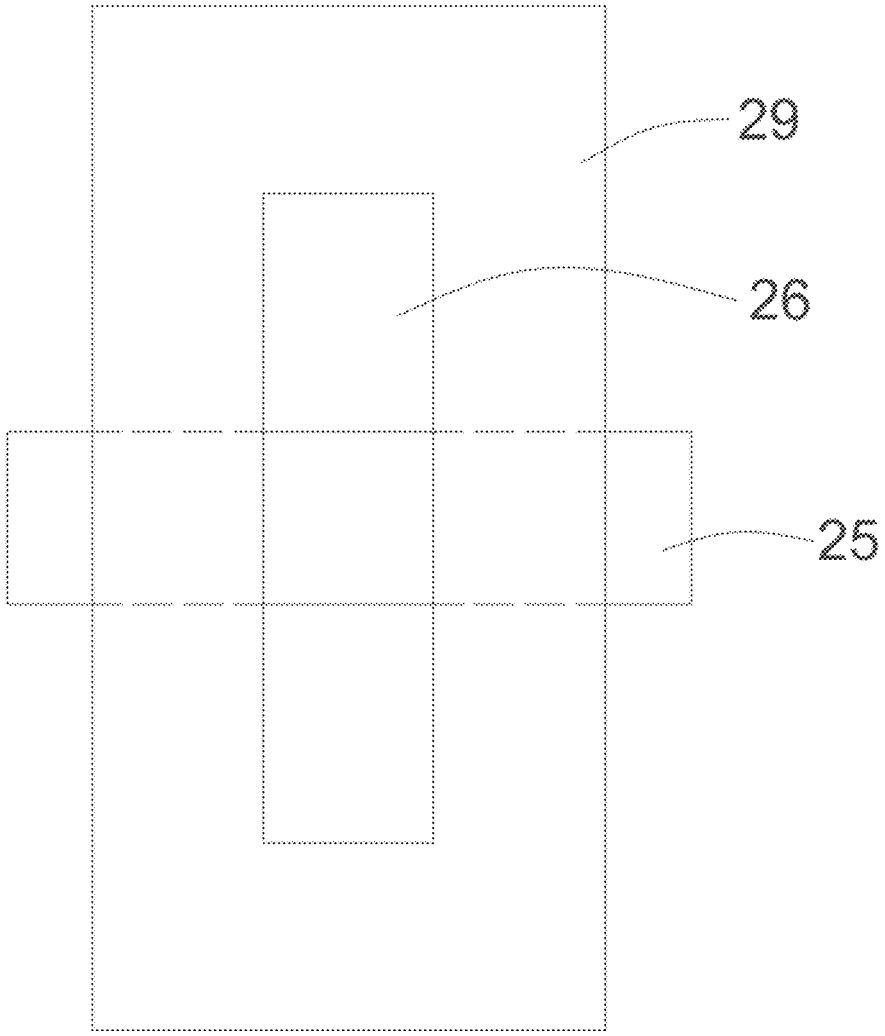
FIG. 5 is a schematic diagram of a bar-shaped pin buckled with a bar-shaped pin hole according to an embodiment of the present disclosure.
Figure 6:
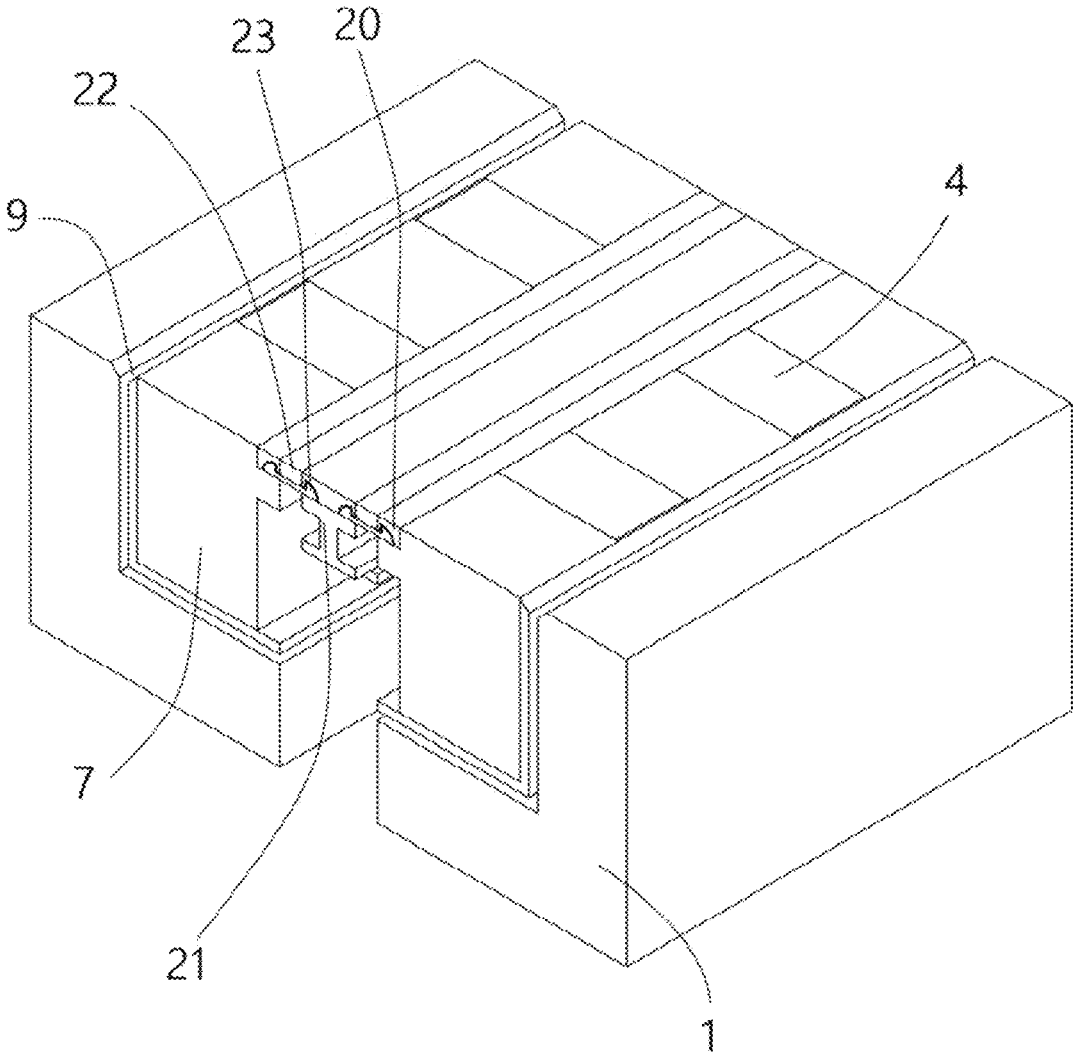
FIG. 6 is a perspective view of a bridge expansion joint according to the present disclosure.

In some embodiments, the connecting box body comprises an L-shaped full-length steel plate 6 matched with the groove platform 2 in appearance, a displacement box 4 and a concrete platform 7, a plurality of displacement boxes 4 are provided and a plurality of concrete platforms 7 are provided, the displacement box 4 is arranged on a steel plate 6 at intervals in the extending direction of the gap 3 and is provided with the box chamber 5 with an opening, and the concrete platform 7 is fixedly installed or poured between adjacent displacement boxes 4. The groove platform 2 features an L-shaped step structure, as illustrated in FIG. 5, and it is configured to match the L-shaped full-length steel plate 6 of the connecting box.

A rubber gasket 8 is arranged between the displacement box 4 and the steel plate 6, the displacement box 4 is fixedly connected the bolts 15 that sequentially penetrate through bolt holes on vertical side surfaces of the displacement box 4, the rubber gasket 8 and the steel plate 6 into the pre-embedded connector on the groove platform 2, and the pre-embedded connector comprises a connecting steel bar 10 and an internal threaded sleeve 11 fixedly connected with the connecting steel bar 10, which are used for connecting and fixing with the bolt 15, facilitating the disassembly, assembly, and connection between the displacement box body 4 and the groove platform 2. The rubber gasket can accommodate the deformation between the steel plate and the displacement box during installation, facilitating smooth removal when replacing the displacement box in the later stage.

Both the steel plate 6 and the groove platform 2 are provided with a space 9 filled with concrete mortar between a vertical direction and a horizontal direction, a rubber baffle 28 for sealing the space 9 is arranged at a port of the space 9 in the horizontal direction, and a grouting hole 13 communicated with the space 9 is formed on horizontal bottom side surfaces of the displacement box 4, the rubber gasket 8 and the steel plate 6 in a penetrating mode and is used for pouring concrete mortar into the space 9.

The grouting hole 13 is arranged to communicate with the space 9 in the horizontal direction, allowing the poured mortar to first fill the space 9 in the horizontal direction before gradually filling the space 9 in the vertical direction. This approach helps to achieve a better filled and sealed concrete mortar structure within the space 9. Additionally, two sides of the space 9 should be sealed with templates or other materials before pouring the mortar.

In some embodiments, the groove platform 2 is fixedly provided with at least one bolt base plate 16 in the space 9 in the horizontal direction, bolts 15 moving up and down are arranged on the displacement box 4, the rubber gasket 8 and the steel plate 6 corresponding to the bolt base plate 16 in a penetrating mode, the bolt 15 abuts against the bolt base plate 16 at a bottom end, and a vertical position height of the displacement box 4 is adjusted by continuing to tighten the bolt 15 upwards or downwards.

The displacement box 4, the rubber gasket 8, and the steel plate 6 are provided with coaxial internal threaded holes for connecting the bolt 15, facilitating the adjustment of the height of the connecting box body by abutting against the bolt base plate 16 via the bolt 1.

Figure 3:
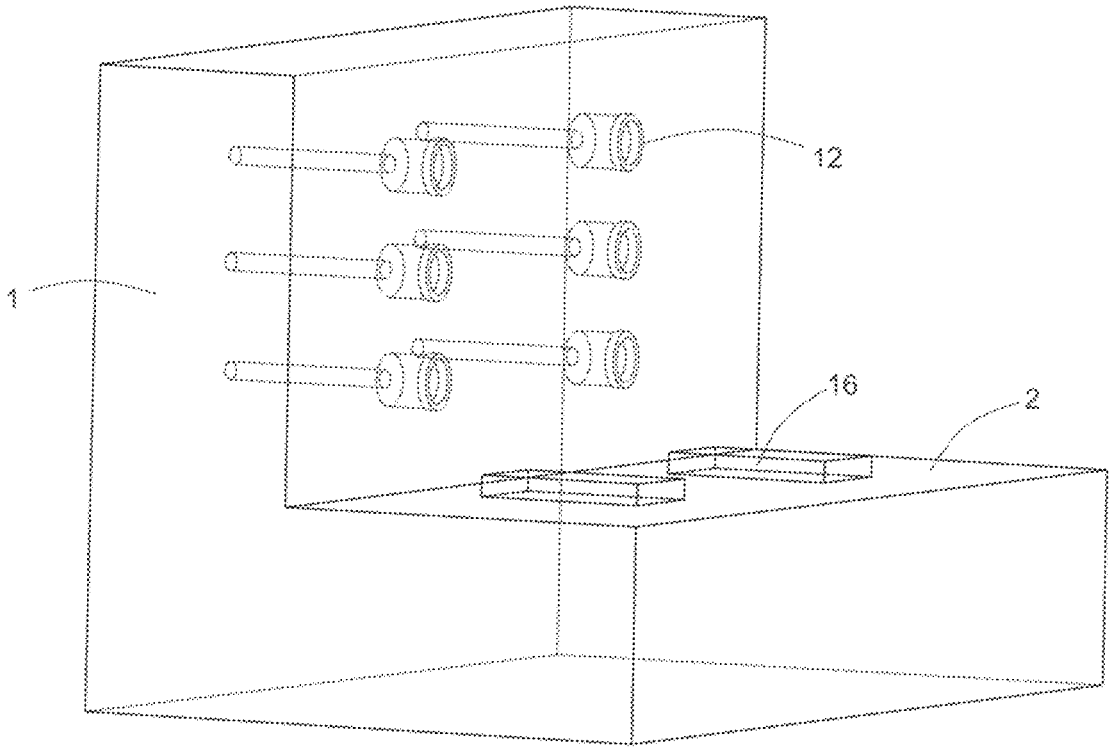
FIG. 3 is a schematic diagram of a bridge beam end L-shaped groove platform according to an embodiment of the present disclosure.

As shown in FIG. 3, to prevent concrete mortar from entering the internal threaded sleeve 11 of the connector when pouring mortar into the space 9, an end of the inner threaded sleeve 11 is provided with a circular rubber pad 12 exposed out of the space 9 in the vertical direction, and an outer end of the circular rubber pad 12 abuts against the vertical side surface of the steel plate 6. The bolt 15, passing through the vertical side, goes through the circular rubber pad 12 before connecting to the internal threaded sleeve 11. In other words, the internal threaded sleeve 11, the circular rubber pad 12, and the bolt 15 opened on the vertical side and passing through the hole are all aligned on the same axis, thereby providing a sealing effect to protect the internal threaded sleeve 11.

To facilitate installation, disassembly, and other operations, a chamfer 14 structure is arranged at L-shaped corners of the displacement box 4, the rubber gasket 8 and the steel plate 6. Additionally, the corresponding L-shaped corner of the groove platform 2 is further provided with a chamfer 14 structure, so that the space 9 forms the chamfer 14 structure at the corner. This design allows the concrete mortar to smoothly pass through the chamfer 14 from the horizontal space 9 to the vertical space 9 during pouring. For example, the chamfer 14 is inclined at a 45-degree angle.

For ease of installation, disassembly, maintenance, and other purposes, the top of the box chamber 5 of the displacement box 4 is provided with a detachable box cover 27, the box cover 27 is connected to a top surface of the box chamber 5 of the displacement box 4 via the bolt 15, and the box cover 27 is covered with a prefabricated concrete plate 24 or a concrete layer 24 poured to cover the box cover 27 to provide protection. Furthermore, to protect the bolts 15 on the box cover 27, bolt protective sleeves or similar devices are sleeved over the corresponding bolts 15.

Figure 4:
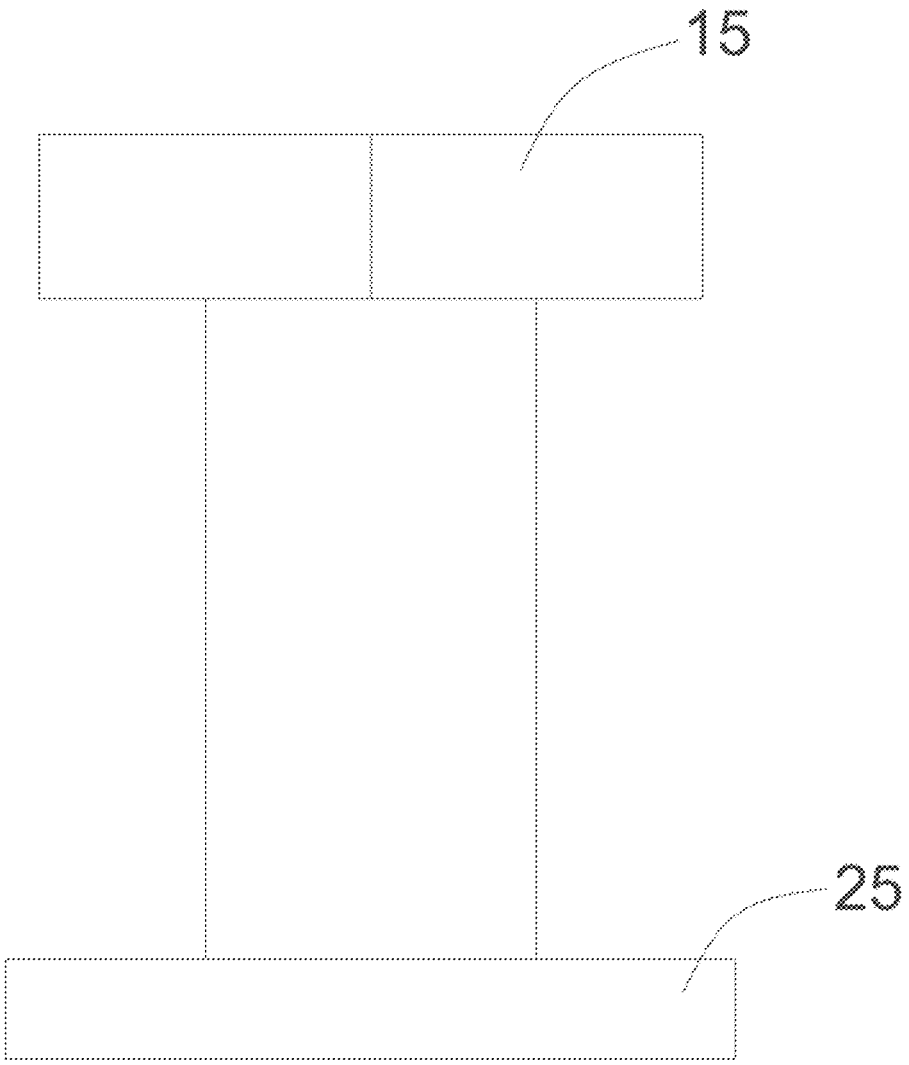
FIG. 4 is a schematic diagram of a bolt with a bar-shaped pin according to an embodiment of the present disclosure.

As shown in FIG. 4, the connection between the box cover 27 and the top of the box chamber 5 is a bolted latch connection. Specifically, a bar-shaped pin 25 is fixedly connected to a bottom of the bolt 15 arranged on the box cover 27 in a penetrating mode, a top end of the box chamber 5 of the displacement box 4 is provided with a fixing plate 29 with a bar-shaped pin hole 26, and the bar-shaped pin 25 penetrates through the bar-shaped pin hole 26 and is screwed to be in vertical cross buckle connection with the bar-shaped pin hole 26.

To prevent issues such as blockage of the expansion joint or aging and rupture of the elastic telescopic piece 23, a groove filled with silicone gel 22 is formed in the extending direction of the gap 3 between the side beam 20, the elastic telescopic piece and the middle beam 21. The silicone gel 22 possesses certain corrosion resistance and abrasion resistance.

In the second aspect, the embodiment of the present disclosure further provides a construction method for the aforementioned easily maintainable and assembled bridge expansion joint structure, which specifically comprises the following steps:

Based on the drawings of the prefabricated expansion device, produce and assemble each component in the factory, including the fixed welding of the middle beam 21 and the cross beam 18, the fixed welding or connection of the side beam 20 to the displacement box 4, the positioning and fixed connection of the elastic supporting seats within the displacement box 4, the reservation of bolt holes on various components, and the prefabrication of concrete platforms 7 on the left and right sides of the displacement box 4.

As shown in FIG. 3, constructing an L-shaped stepped groove platform 2 at each of two to-be-connected bridge beam ends 1, pre-embedding a pre-embedded connector formed by fixedly connecting a connecting steel bar 10 and an inner threaded sleeve 11 on a vertical side surface of a groove platform 2, pre-embedding or sleeving a circular rubber pad 12 at a port of the pre-embedded connector, and fixedly arranging at least one bolt base plate 16 on a horizontal bottom surface of the groove platform 2.

Assembling a displacement box 4, a rubber gasket 8 and a L-shaped full-length steel plate 6 together with bolts 15 on their respective transverse bottom surfaces to form a connecting box body, using a hoisting machinery to hoist the assembled connecting box body onto the corresponding groove platform 2 at the bridge beam end 1, so that the connecting box body is placed on the groove platform 2 in the extending direction of a gap 3 and horizontally positioned in the front, back, left and right directions.

Adjusting the bolts 15 at the horizontal bottom surface to abut against the corresponding bolt base plate 16, and continuing to tighten the bolts 15 to adjust the vertical height position of the displacement box 4, after reaching the design elevation, fixedly connecting the bolts 15 that sequentially penetrate through bolt holes on vertical side surfaces of the displacement box 4, the rubber gasket 8 and the steel plate 6 into the internal threaded sleeve 11 of the pre-embedded connector on the groove platform 2, and abutting the circular rubber pad 12 against an outer side surface of the L-shaped steel plate 6, so that a space 9 with a certain distance is reserved between the L-shaped steel plate 6 and the groove platform 2 in the horizontal direction and the vertical direction, and arranging a sealing rubber baffle 28 at a port of the space 9 in the horizontal direction.

Sealing two sides of the space 9 between the steel plate 6 of the connecting box body and the groove platform 2, and injecting concrete mortar through grouting holes 13 penetrating the horizontal bottom surfaces of the displacement box 4, the rubber gasket 8 and the steel plate 6 until the mortar fills the space 9 and overflows from a top of the space 9 in the vertical direction.

Arranging the cross beams 18 on inner bottom plates of the box chambers 5 of the opposite displacement boxes 4 of the two bridge beam ends 1 via the first elastic supporting seat 17, stretching the two side beams 20 across a plurality of cross beams 18 in the extending direction of the gap 3 and fixedly connecting the two side beams 20 to top surfaces of the cross beams 18 via a second elastic supporting seat 19, fixing a bottom of a middle beam 21 onto the cross beams 18 and positioning the bottom of the middle beam 21 between the two side beams 20, and fixedly connecting one end of the top of each side beam 20 to the top of the box chamber 5 of the displacement box 4 while elastically connecting another end to the top of the middle beam 21 via an elastic telescopic piece 23.

Fixedly connecting a bolt with a bar-shaped pin 25 to a box cover 27 in a penetrating mode, penetrating the bar-shaped pin 25 through a fixing plate 29 with a bar-shaped pin hole 26 in a top end of the box chamber 5, and screwing the bolt 15 until the bolt 15 is buckled at a point where the bar-shaped pin 25 and the bar-shaped pin hole 26 intersect perpendicularly, so that the box cover 27 is connected to the top of the box chamber 5 of the displacement box 4.

Hoisting and fixing a prefabricated concrete platform 7, matched with the space 9 enclosed by an adjacent displacement box 4 and a steel plate 6 between the two adjacent displacement boxes 4, hoisting a concrete plate 24 to cover a top surface of the box cover 27 or pouring a concrete layer 24 to cover the top surface of the box cover 27, and pouring silicone gel 22 in a groove 30 formed in the extending direction of the gap 3 between the side beam 20, the elastic telescopic piece 23 and the middle beam 21.

In the embodiment, when the expansion joint structure needs to be maintained or replaced, the bolt 15 with the bar-shaped pin 25 on the box cover 27 is loosened, the bar-shaped pin 25 and the bar-shaped pin hole 26 are aligned in the same direction to remove the box cover 27, and the bolt 15 on the vertical side of the connecting box body is loosened to remove the entire connecting box body;

or the elastic telescopic piece 23 is loosened and removed to separate the side beam 20 from the displacement box 4, so that a space 9 is arranged between the opposite displacement boxes 4 at the bridge beam end 1, and maintenance or replacement of the cross beam 18, the first elastic supporting seat 17, the second elastic supporting seat 19 and the middle beam 21 is facilitated.

The above descriptions are only the preferred embodiments of the present disclosure. It should be noted that, for a person of ordinary skill in the art, numerous improvements and modifications can be made without departing from the principles of the present disclosure, and such improvements and modifications should also be considered within the scope of protection of the present disclosure.

What is claimed is:

1. An easily maintainable assembly-type bridge expansion joint structure, comprising:

two to-be-connected bridge beam end, wherein a groove platform is provided on each of the two to-be-connected bridge beam ends in an extending direction of a gap;

two connecting box bodies, wherein each of the two connecting box bodies is fixedly arranged on the groove platform of each of the two to-be-connected bridge beam end, and a box chamber is provided on opposite side surfaces of the two connecting box bodies respectively, a plurality of box chambers are provided, which are open opposite each other, and the box chamber is provided in the extending direction of the gap;

at least one cross beam, wherein the at least one cross beam is connected to the two box bodies via the box chambers respectively, and bottoms of the two ends of the at least one cross beam is connected to an inner bottom plate of the box chamber that is open opposite each other via a first elastic supporting seat respectively;

a side beam, wherein a number of the side beam is two, the side beam spans the at least one cross beam in the extending direction of the gap, a bottom of the side beam is connected to a top of the at least one cross beam via a second elastic supporting seat, and a top of the side beam is fixedly connected to a top of the box chamber;

at least one middle beam, a bottom of the middle beam is fixedly arranged on the at least one cross beam and located between the two side beams, and two sides of a top of the middle beam are elastically connected to the tops of the two side beams via an elastic telescopic piece respectively, a groove in the extending direction of the gap is formed between the side beam, the elastic telescopic piece and the middle beam, and the groove is configured to be filled with silicone gel;

each of the two connecting box bodies comprises an L-shaped full-length steel plate matched with the groove platform in appearance, a displacement box and a concrete platform, a plurality of displacement boxes are provided and a plurality of concrete platforms are provided, the displacement box is arranged in the box chamber on a steel plate at intervals in the extending direction of the gap, and the concrete platform is fixedly installed or poured between adjacent displacement boxes; and a rubber gasket is arranged between the displacement box and the steel plate, the displacement box is connected to a pre-embedded connector of the groove platform via a bolt, the bolt sequentially penetrates through bolt holes on vertical side surfaces of the displacement box, the rubber gasket and the steel plate and is connected to the pre-embedded connector of the groove platform, and the pre-embedded connector comprises a connecting steel bar and an internal threaded sleeve fixedly connected with the connecting steel bar.

2. The easily maintainable assembly-type bridge expansion joint structure according to claim 1, wherein both the steel plate and the groove platform are provided with a space filled with concrete mortar between a vertical direction and a horizontal direction, a rubber baffle for sealing the space is arranged at a port of the space in the horizontal direction, and a grouting hole communicated with the space is formed on horizontal bottom side surfaces of the displacement box, the rubber gasket and the steel plate in a penetrating mode and is configured to pour concrete mortar into the space.

3. The easily maintainable assembly-type bridge expansion joint structure according to claim 2, wherein the groove platform is fixedly provided with at least one bolt base plate in the space in the horizontal direction, the displacement box, the rubber gasket and the steel plate corresponding to the bolt base plate are penetrated with bolts that move up and down, the bolt abuts against the bolt base plate at a bottom end, and a vertical position height of the displacement box is configured to be adjusted by continuing to tighten the bolt upwards or downwards.

4. The easily maintainable assembly-type bridge expansion joint structure according to claim 3, wherein an end of the inner threaded sleeve is provided with a circular rubber pad exposed out of the space in the vertical direction, and an outer end of the circular rubber pad abuts against the vertical side surface of the steel plate; and a chamfer is arranged at L-shaped corners of the displacement box, the rubber gasket and the steel plate.

5. The easily maintainable assembly-type bridge expansion joint structure according to claim 1, wherein the top of the box chamber of the displacement box is provided with a detachable box cover, the box cover is connected to a top surface of the box chamber of the displacement box via the bolt, and the box cover is covered with a prefabricated concrete plate or a concrete layer poured to cover the box cover.

6. The easily maintainable assembly-type bridge expansion joint structure according to claim 5, wherein a bar-shaped pin is fixedly connected to a bottom of the bolt arranged on the box cover in a penetrating mode, a top end of the box chamber of the displacement box is provided with a fixing plate with a bar-shaped pin hole, and the bar-shaped pin penetrates through the bar-shaped pin hole and is screwed to be in vertical cross buckle connection with the bar-shaped pin hole.

7. A construction method for an easily maintainable assembly-type bridge expansion joint structure according to claim 1, comprising the following steps:

constructing an L-shaped stepped groove platform at each of the two to-be-connected bridge beam ends, pre-embedding a pre-embedded connector formed by fixedly connecting a connecting steel bar and an inner threaded sleeve on a vertical side surface of a groove platform, pre-embedding or pasting a circular rubber pad at a port of a pre-embedded connector, and fixedly arranging at least one bolt base plate on a horizontal bottom surface of the groove platform;

assembling a displacement box, a rubber gasket and a L-shaped full-length steel plate together with bolts on their respective transverse bottom surfaces to form a connecting box body, using a hoisting machinery to hoist an assembled connecting box body onto the corresponding groove platform at each of the two to-be-connected bridge beam end, so that the connecting box body is placed on the groove platform in an extending direction of a gap and horizontally positioned in front, back, left and right directions;

adjusting the bolts at a horizontal bottom surface to abut against the corresponding bolt base plate, and continuing to tighten the bolts to adjust a vertical height position of the displacement box, after reaching a design elevation, fixedly connecting the bolts that sequentially penetrate through bolt holes on vertical side surfaces of the displacement box, the rubber gasket and a steel plate into an internal threaded sleeve of the pre-embedded connector on the groove platform, and abutting the circular rubber pad against an outer side surface of a L-shaped steel plate, so that a space with a certain distance is reserved between the L-shaped steel plate and the groove platform in a horizontal direction and a vertical direction, and arranging a sealing rubber baffle at a port of the space in the horizontal direction;

sealing two sides of the space between the steel plate of the connecting box body and the groove platform, and injecting concrete mortar through grouting holes penetrating horizontal bottom surfaces of the displacement box, the rubber gasket and the steel plate until the mortar fills the space and overflows from a top of the space in the vertical direction;

arranging the at least one cross beam on inner bottom plates of box chambers of opposite displacement boxes of the two to-be-connected bridge beam ends via a first elastic supporting seat, stretching two side beams across the at least one cross beam in the extending direction of the gap and fixedly connecting the two side beams to top surfaces of the at least one cross beam via a second elastic supporting seat, fixing a bottom of a middle beam onto the at least one cross beam and positioning the bottom of the middle beam between the two side beams, and fixedly connecting one end of a top of each side beam to a top of each of the box chambers of the displacement box while elastically connecting another end to a top of the middle beam via an elastic telescopic piece;

fixedly connecting a bolt with a bar-shaped pin to a box cover in a penetrating mode, penetrating the bar-shaped pin through a fixing plate with a bar-shaped pin hole in a top end of each of the box chambers, and screwing the bolt until the bolt is buckled at a point where the bar-shaped pin and the bar-shaped pin hole intersect perpendicularly, so that the box cover is connected to the top of each of the box chambers of the displacement box; and hoisting and fixing a prefabricated concrete platform, matched with the space enclosed by an adjacent displacement box and a steel plate between the two adjacent displacement boxes, hoisting a concrete plate to cover a top surface of the box cover or pouring a concrete layer to cover the top surface of the box cover, and pouring silicone gel in a groove formed in the extending direction of the gap between the two side beams, the elastic telescopic piece and the middle beam.

8. The construction method for the easily maintainable assembly-type bridge expansion joint structure according to claim 7, wherein when the expansion joint structure needs to be maintained or replaced, the bolt with the bar-shaped pin on the box cover is loosened, the bar-shaped pin and the bar-shaped pin hole are aligned in a same direction to remove the box cover, and the bolt on a vertical side of the connecting box body is loosened to remove the entire connecting box body;

or the elastic telescopic piece is loosened and removed to separate the side beam from the displacement box, so that a space is arranged between the opposite displacement boxes at the bridge beam end, and maintenance or replacement of the at least one cross beam, the first elastic supporting seat, the second elastic supporting seat and the middle beam is facilitated.

* * * * *